United States Patent [19]

Wang

[11] Patent Number: 4,878,712

[45] Date of Patent: Nov. 7, 1989

[54] HYDRAULIC METHOD OF MINING COAL

[76] Inventor: Fun-Den Wang, 108 S. Eldridge Way, Golden, Colo. 80401

[21] Appl. No.: 243,478

[22] Filed: Sep. 9, 1988

[51] Int. Cl.[4] ..... F21C 25/60; E21C 41/00

[52] U.S. Cl. ..... 299/10; 299/17

[58] Field of Search ..... 299/10, 11, 16, 17, 299/19

[56] References Cited

U.S. PATENT DOCUMENTS

| | | | |
|---|---|---|---|
| 2,298,599 | 10/1942 | Smith | 299/19 X |
| 4,079,999 | 3/1978 | Grimley | 299/19 X |
| 4,479,541 | 10/1984 | Wang | 166/268 |
| 4,496,191 | 1/1985 | Choi et al. | 299/17 |

FOREIGN PATENT DOCUMENTS

| | | | |
|---|---|---|---|
| 711291 | 1/1980 | U.S.S.R. | 299/19 |
| 724735 | 3/1980 | U.S.S.R. | 299/11 |
| 829947 | 3/1981 | U.S.S.R. | 299/11 |

OTHER PUBLICATIONS

*Elements of Hydraulic Coal Mine Design,* M. L. Heremic, Trans. Tech. Publications, 1982, TN803.J47, pp. 9–23, 62–104.

"Status of Hydraulic coal Mining in People's Republic of China", Fun Den Wang, Colorado School of Mines, 9–1987.

"Hydraulic Mining of Thick and Steep Coal Seams in the Soviet Union" by Vladimir M. Kolesnikov, Deputy Tech. Dir., Gidrougol Coal Prod. Assoc., Soviet Un. (May 1980).

"History of Hydraulic Mining at Kaiser" by D. M. Parkes, Manager, New Mines Develop Kaiser Resources LTD., Vancouver, British Columbia, Canada, May, 1980.

"Introduction to Hydraulic Mining and Jet Cutting" by Jacob N. Frank, Energy Research & Development Administration, U.S.A., May, 1976.

*Primary Examiner*—Jerome W. Massie
*Assistant Examiner*—David J. Bagnell
*Attorney, Agent, or Firm*—Dorr, Carson, Sloan & Peterson

[57] ABSTRACT

Coal is mined using water jets to a remove a layer of thin horizontal slices of coal. The thickness of the layer is sufficiently small that elastic deformation of the roof of the layer due to settling will cause the roof to rest against the floor of the layer. A number of additional layers of slices are then extracted in the same manner, each immediately below the floor of the preceding layer. The thickness and location of these layers wiht respect to previous layers is such that elastic deformation of the roof of the first layer due to settling will cause the roof to rest against the floor of the last layer of slices. Through the sequential mining of layers in this manner from top to bottom, the entire seam of coal is extracted and the mine roof rests upon the mine floor without the need for artificial roof support.

22 Claims, 4 Drawing Sheets

HYDRAULIC METHOD OF MINING COAL

BACKGROUND OF THE INVENTION

1. Field of the Invention

The present invention relates generally to the field of hydraulic mining, and in particular to mining thin slices of coal or other minerals deposits by means of water jets.

2. Statement of the Problem

Various types of water jets have long been used in the mining industry for the purpose of extracting mineral deposits by disrupting the mineral structure and forming a slurry of the resulting mineral particles. For example, large water jets, known as "giants" or "monitors," have been used in placer mining operations of precious metals for over a century. A good general history of hydraulic mining is provided by Frank, "Introduction to Hydraulic Mining and Jet Cutting" (BHRA Fluid Engineering, Cranfield, Bedford, England, 1976).

The room-and-pillar and longwall methods of mining are predominantly used in recovery of underground coal for seams ranging from 3 to 10 feet. In both methods, the entire seam is extracted in one pass. Mining of the complete seam in one pass is necessary to allow use of conventional mining equipment. Furthermore, this is conventionally thought to be the most efficient method of underground coal extraction. However, the roof of the excavated seam tends to be unstable and has been a major cause of fatality in the coal mining industry. The conventional approach to this problem has been to artificially support the mine roof by means of bolting, timbering, and/or hydraulic jacks. This imposes major economic constraints in mining operations by interrupting the continuity of the mining and haulage process and forcing the operation to become cyclic.

Hydraulic mining with water jets has been used for many years to extract coal deposits in China, Canada, Poland and the U.S.S.R. General reports concerning these efforts are provided by Kolesnikov, "Hydraulic Mining of Thick and Steep Coal Seams in the Soviet Union"; Parkes, "History of Hydraulic Mining at Kaiser" (both papers presented at the First International Symposium of Thick and Steep Seam Coal Mining, London, England, May 18–21, 1980); and by applicant's paper entitled "Status of Hydraulic Coal Mining in People's Republic of China" (Colorado School of Mines, Golden, Colorado). Further information in this area is provided in the treatise by Jeremic, *Elements of Hydraulic Coal Mine Design* (Trans Tech Publications, 1982).

However, under the prior art, water jets are used simply as a substitute for conventional cutting or excavating techniques in standard room-and-pillar, short wall, or long wall mining methods. The safety problems and economic constraints associated with providing artificial support for the mine roof have heretofore remained unsolved.

The most pertinent prior art reference appears to be U.S. Pat. No. 4,479,541 issued to the present applicant on Oct. 30, 1984 for "Method and Apparatus for Recovery of Oil, Gas and Mineral Deposits by Panel Opening." This patent disclosed a method and apparatus which employs panel openings to increase the surface area of drill holes to thereby enhance recovery of oil or gas. This method is also applicable to oil shale and tar sand recovery, as well as in-situ leaching of minerals such as uranium.

3. Solution to the Problem

Nothing in the prior art teaches or suggests use of a water jet to mine a series of thin horizontal slices of coal as taught by the present invention. Using conventional mining techniques, a mine roof can deflect elastically in the range of 6 to 12 inches and often as much as 2 to 3 feet or more with thin coal seams. By successively extracting thin horizontal slices of coal instead of the entire seam, the deflected mine roof will be supported by the remaining coal that forms the floor of the slices. Additional layers of horizontal slices can then be extracted from under the first layer of slices to maintain a gentle deflection and to preserve the integrity of the mine roof. This method substantially eliminates the need to provide artificial support for the mine roof. This method is also readily adaptable to remote control and automation which further reduces costs of production, and minimizes the risk of injury to miners.

SUMMARY OF THE INVENTION

This invention provides a method of mining coal using water jets to a remove a series of thin horizontal slices of coal in a substantially horizontal plane. The upper and lower surfaces of these slices form a substantially continuous roof and floor, respectively, above and below the slices. The thickness of the slices is sufficiently small that elastic downward deformation of the roof caused by settling will result in a portion of the roof resting against a portion of the floor. This allows the integrity of the mine roof to be maintained.

A number of additional layers are then extracted, each layer consisting of a number of thin horizontal slices of coal in a substantially horizontal plane immediately below the floor of the preceding layer of slices. Once again, the thickness of these slices and the location of these slices with respect to previous layers is such that elastic deformation of the roof of the first layer caused by settling will result in a portion of the roof being supported by a portion of the floor of the last layer of slices.

Through the sequential mining of layers in this manner from top to bottom, the entire seam of coal is extracted and the mine roof rests upon the mine floor without the need for artificial roof support. This provides substantial advantages in terms of economic savings to the mine operator. Furthermore, due to the fact that miners do not need to enter the areas of the coal seam being excavated, the present method provides improved safety conditions for the miners.

Another advantage of the present invention is the fact that any subsidence of the surface of the earth caused by mining coal in accordance with the present method will occur within a relatively short period of time following excavation of the coal deposit. In contrast, conventional coal mines can continue to cause unpredictable surface subsidence for decades following abandonment of the mine as artificial roof supports gradually fail.

Yet another advantage is the fact that few, if any, underground tunnels or chambers remain in the coal deposit following completion of mining in accordance with the present invention. This substantially eliminates the problems of underground coal fires and acid mine drainage associated with conventional underground coal mining techniques.

These and other advantages, features, and objects of the present invention will be more readily understood in view of the following detailed description and the drawings.

BRIEF DESCRIPTION OF THE DRAWINGS

The present invention can be more readily understood in conjunction with the accompanying drawings, in which.

DETAILED DESCRIPTION OF THE INVENTION

Figure 1:
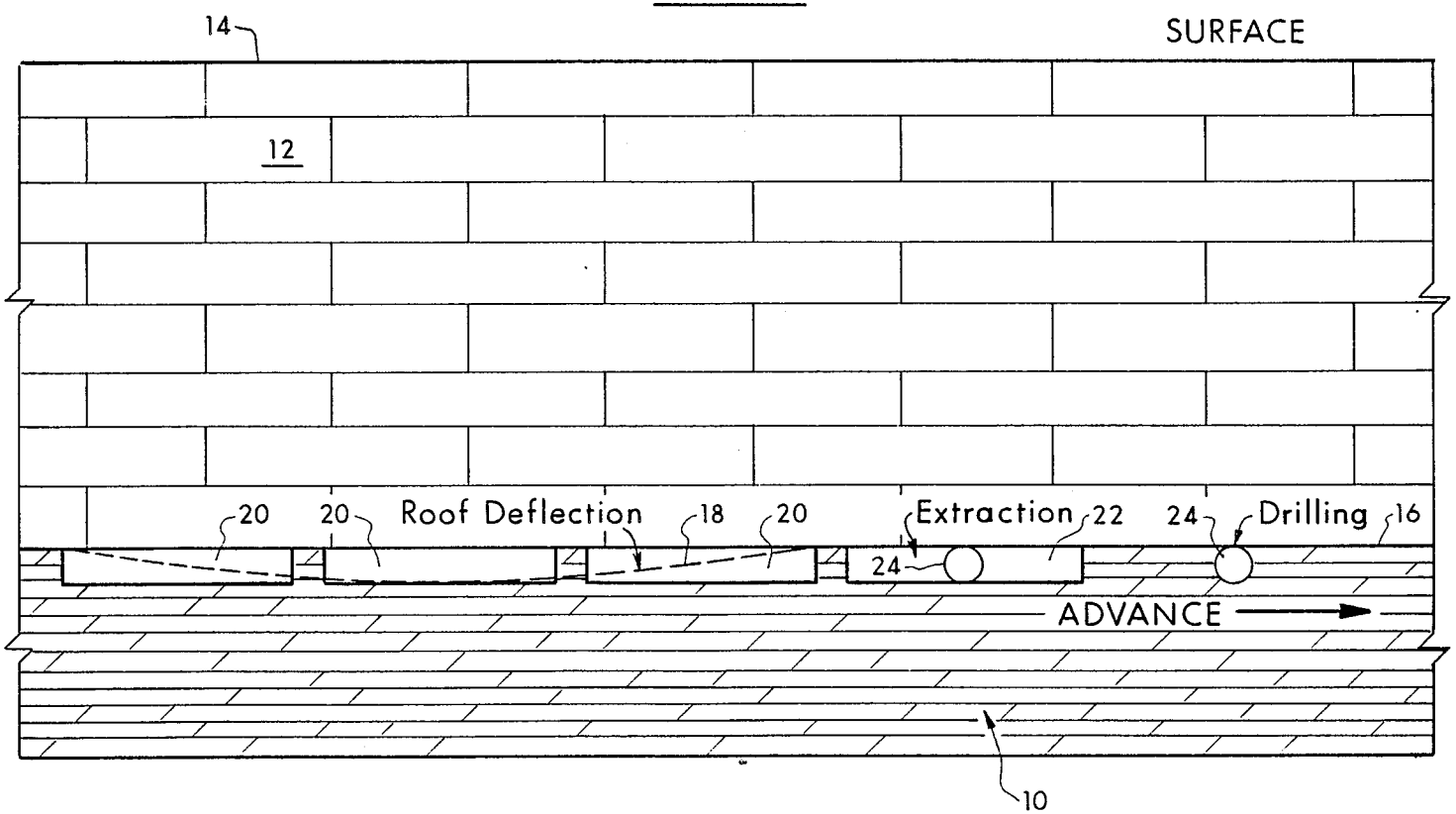
FIG. 1 is a schematic vertical cross-sectional view of a seam of coal and the surrounding geological strata, showing the mining sequence of a single horizontal row of slices of coal extracted by water jets in accordance with the present invention. Also shown is the resulting downward deflection of the roof of these slices caused by settling of the strata above the seam of coal.
Figure 2:
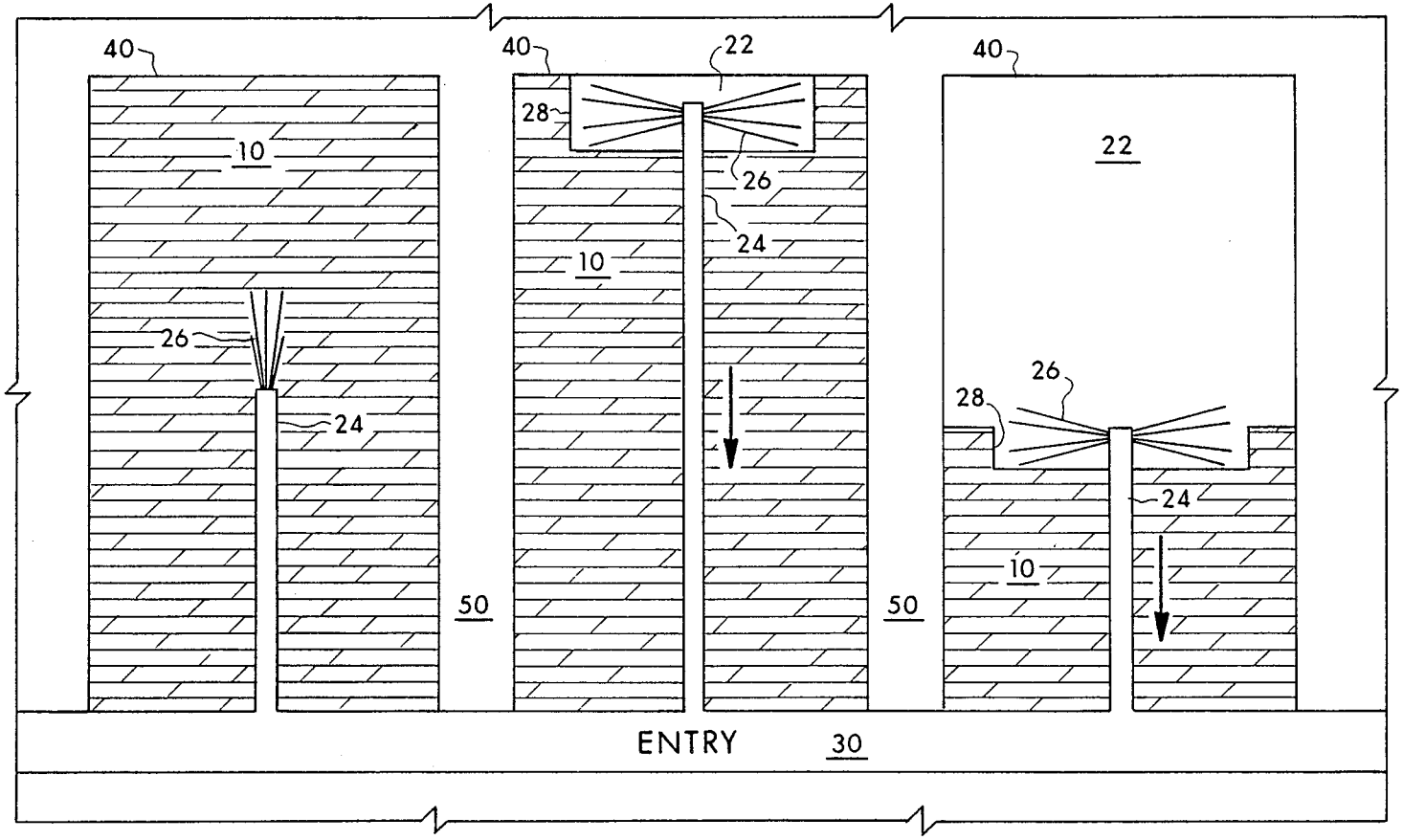
FIG. 2 is a schematic plan view of three slices showing the sequence of steps in extracting coal from each slice.

FIG. 1 is a schematic vertical cross-sectional view showing the surface of the earth 14, an underground seam of coal 10 extending in a substantially horizontal direction, and the overburden 12 above the coal seam. FIG. 2 is a schematic plan view of three slices showing the sequence of steps in extracting coal from each slice. FIGS. 1 and 2 illustrate the mining sequence of a single horizontal row or layer of thin horizontal slices 20 excavated by water jets in accordance with the present invention. All of the slices in a single layer fall in a substantially horizontal plane. The upper and lower surfaces of the slices form a substantially continuous roof and floor, respectively, above and below the slices.

Figure 4:
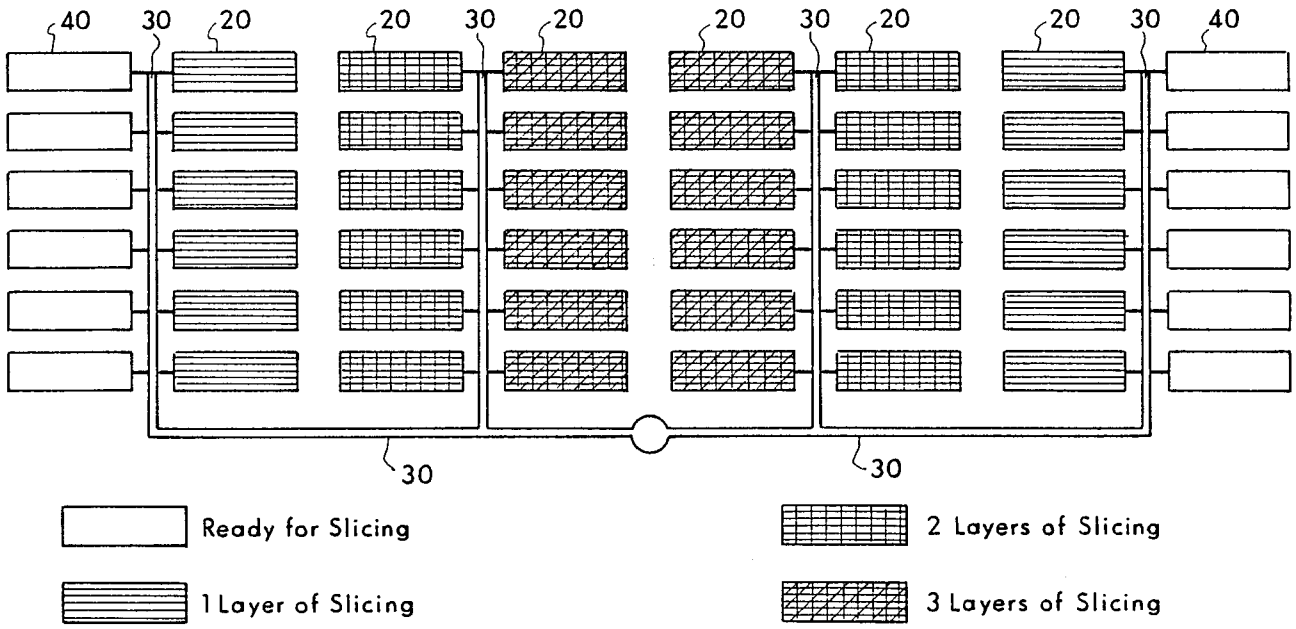
FIG. 4 is a schematic plan view showing use of multiple entries and sub-entries to facilitate access to multiple fields of slices.

As a first step, an entry tunnel 30 is created by conventional means to provide lateral access to the coal seam to be mined, as shown in FIGS. 2 and 4. In one embodiment of the present invention, each of the horizontal slices is formed by drilling a borehole 24 horizontally from the entry into the coal seam, as shown on the right section of FIG. 1 and on the left section of FIG. 2.

A water jet 26 is then inserted from the entry through the length of the borehole, as shown in the middle section of FIG. 2, to cut and erode the coal in a thin horizontal slice extending laterally from either side of the borehole. The resulting slurry of coal particles is pumped or drains by back-pressure or gravity through the borehole and into the entry for processing. The water jet is gradually pulled back along the borehole as coal is extracted from the slice and the excavated volume 22 gradually increases, as shown in FIG. 2. The result is excavation of coal from a thin, horizontal slice having a substantially rectangular horizontal cross-section 40, as shown in the right section of FIG. 2. Alternatively, the horizontal slices can be directly excavated in an outward direction from the entry.

A thin separating wall 50 is maintained between horizontally adjacent slices. This serves to control fluid flow between slices and insures that the coal slurry drains out of the desired borehole.

The three slices 20 on the left side of FIG. 1 are shown in a fully excavated state. Due to the weight of the overburden 12, the roof 16 of the coal seam above the excavated slices will gradually experience downward deflection and assume the shape designated as 18. The thickness of these slices is sufficiently small that elastic deformation of the roof will allow a portion of the roof to come into contact with, and rest against the floor of the excavated slices. In this manner, the roof 18 of the mine is supported by the coal floor without artificial support. Due to the fact that stresses experienced by the roof remain within the elastic range, integrity of the roof is maintained as the slices are excavated. A slice thickness of approximately one to two feet will be suitable in most applications. Each slice may be 20 to 80 feet wide and 100 to 300 feet long depending upon the geological condition of the coal deposit, as well as the water jet cutting arrangement and slurry pumping capacity.

Figure 3:
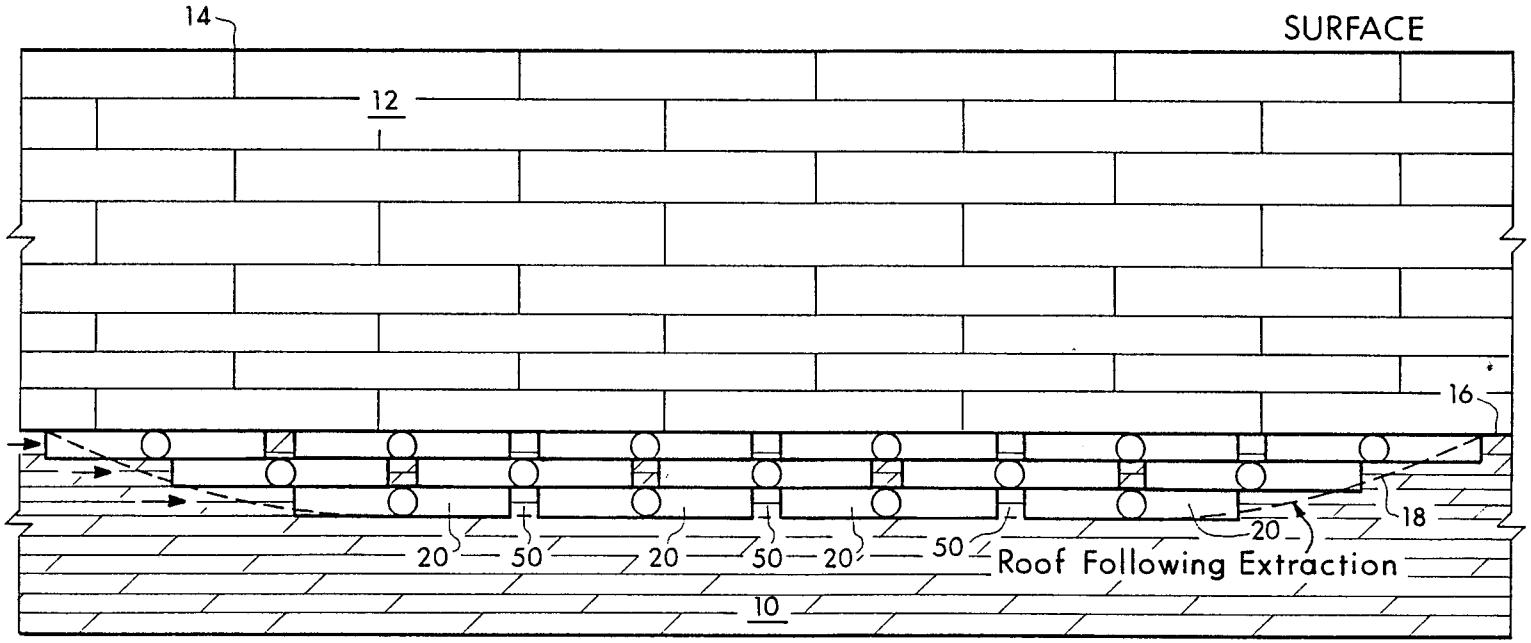
FIG. 3 is a schematic vertical cross-sectional view similar to FIG. 1 showing the mining sequence of three offset layers or rows of slices in accordance with the present invention.

Following excavation of the initial layer of slices, second and additional successive layers are then excavated, each immediately below the floor of the preceding layer. FIG. 3 is a schematic vertical cross-sectional view similar to FIG. 1 showing the mining sequence of three layers of slices 20 in accordance with the present invention. Each layer is comprised of a number of horizontal slices excavated in accordance with the method described above. The vertical thickness of these slices and the location of these slices with respect to previous layers is such that elastic downward deformation of the roof of the first layer due to settling will cause a portion of the roof 18 to contact and be supported by a portion of the floor of the last layer of slices.

As shown in FIG. 3, the slices 20 in each subsequent layer are not in vertical alignment with respect to the slices of the previous layer. Each slice in a subsequent layer underlies portions of at least two slices in the previous layer. This provides a means to shape the floor of the excavated volume to accurately match the elastic deformation of the roof 18. In particular, the horizontally opposed sides of each subsequent layer of slices are within the horizontal periphery of the previous layer of slices, thereby creating a contoured floor of the excavated volume that tapers inward and downward with each subsequent layer of slices.

In addition, each slice 20 in a subsequent layer underlies the thin wall of coal 50 left between slices in the preceding layer. These separating walls 50 remaining from the preceding layer will collapse into the slice below as it is excavated, and are thereby removed from the excavated volume. The separating walls 50 between horizontally adjacent slices in the last, bottom layer are not removed. The weight of the overburden and gradual settling of the roof above the excavated volume will crush and flatten the remaining separating walls in the bottom layer.

Alternatively, additional layers of slices 20 can be extracted in a substantially horizontal plane immediately above the roof of the preceding layer of slices. This accomplishes essentially the same result as described above by excavating the layers in reverse order, from the bottom to the top. Once again, the vertical thickness and location of these slices with respect to previous layers is such that elastic downward deformation of the roof 18 of the last layer will cause a portion of the roof to contact and be supported by a portion of the floor of the first layer of slices. The horizontally opposed sides of each subsequent layer of slices expand beyond the horizontal periphery of the previous layer of slices, thereby creating a contoured floor of the excavated volume formed by the layers of slices which tapers upward and outward with each subsequent layer of slices.

Yet another alternative is to excavate a first layer of slices in a horizontal plane at some point in the middle of the coal seam, and then extract subsequent layers both above and below the first layer. Excavation of layers proceeds from the middle of the seam to both the top and bottom of the seam.

FIG. 4 is a schematic plan view showing use of multiple entries and sub-entries 30 to facilitate access to multiple fields of slices 20. This allows the coal or other deposit to be excavated from a much larger area than would be possible with a single field of slices. As shown in FIG. 4, the geographical arrangement of the fields, and the number of layers excavated from each field can be designed to allow a gentle deflection of the roof in both directions over the entire area being mined.

The above disclosure sets forth a number of embodiments of the present invention. Other arrangements or embodiments, not precisely set forth, could be practiced under the teachings of the present invention and as set forth in the following claims.

I claim:

1. A mining method primarily intended for mining coal and other deposits, comprising:

(a) providing an entry adjacent to at least a portion of the deposit to be mined; and (b) extracting through said entry a substantially horizontal layer of adjacent slices from the deposit by the steps of:

(1) drilling a substantially horizontal borehole from said entry extending the length of the slice to be extracted, and (2) introducing a water jet into said borehole and extracting said slice of deposit extending laterally from said borehole by means of said water jet, each of said slices extending in a substantially horizontal plane and having an upper and lower surface, the upper and lower surfaces of said slices forming a substantially continuous roof and floor, respectively, above and below said slices, the vertical separation between said surfaces being sufficiently small that elastic downward deformation of said roof due to settling will cause a portion of said roof to contact and be supported by a portion of said floor.

2. The method of claim 1, wherein during the extraction of step (b), a thin wall is left between horizontally adjacent slices.

3. The method of claim 1, wherein said horizontal slices have a substantially rectangular cross-section.

4. The method of claim 1, wherein extraction of said deposit commences at the distal end of said borehole and proceeds back along the length of said borehole toward said entry.

5. A mining method primarily intended for mining coal and other deposits, comprising:

(a) providing an entry adjacent to at least a portion of the deposit to be mined;

(b) extracting through said entry a first, substantially horizontal layer of adjacent slices from the deposit, each of said slices extending in a substantially horizontal plane and having an upper and lower surface, the upper and lower surfaces of said slices forming a substantially continuous roof and floor, respectively, above and below said slices, the vertical separation between said surfaces being sufficiently small that elastic downward deformation of said roof due to settling will cause a portion of said roof to contact and be supported by a portion of said floor; and (c) subsequently extracting through said entry at least a second layer from the deposit, said second layer comprising a number of adjacent, horizontally-extending slices in a substantially horizontal plane immediately below the floor of the first layer of slices, each slice of said second layer having a lower surface with the lower surfaces of the slices of said second layer forming a substantially continuous floor wherein the vertical thickness and location of said slices of said second layer with respect to the slices of said first layer are such that elastic downward deformation of the roof of said first layer due to settling will cause a portion of said roof to contact and be supported by a portion of the floor of the second layer of slices.

6. The method of claim 5, wherein at least one slice in said second layer is not in vertical alignment with respect to the slices of the first layer, so that said slice in said second layer underlies portions of at least two slices in the first layer.

7. The method of claim 5, wherein the first and second layers have horizontally opposed sides and the horizontally opposed sides of said second layer of slices are within the horizontally opposed sides of the first layer, thereby creating a contoured floor of the excavated deposit that tapers inward and downward from said first layer to said second layer.

8. The method of claim 5, wherein during the respective extracting of steps (b) and (c), a thin wall is left between horizontally adjacent slices in each layer.

9. The method of claim 8, wherein at least one slice in said second layer is not in vertical alignment with respect to the slices of the first layer, so that said slice in said second layer underlies portions of at least two slices in the first layer, and underlies the thin wall separating said two slices in said first layer.

10. The method of claim 5, wherein at least one of said slices is extracted by the steps of:

(a) drilling a substantially horizontal borehole from said entry extending through the length of the slice to be extracted; and (b) introducing a water jet into said borehole and extracting said slice of deposit extending laterally from said borehole by means of said water jet.

11. The method of claim 10 wherein said borehole is defined in part by opposing sides and two thin horizontal slices of deposit are extracted from said opposing sides of said borehole.

12. The method of claim 10, wherein said horizontal slices have a substantially rectangular cross-section.

13. The method of claim 10, wherein extraction of said deposit commences at the distal end of said borehole and proceeds back along the length of said borehole toward said entry.

14. A mining method primarily intended for mining coal and other deposits, comprising:

(a) providing an entry adjacent to at least a portion of the deposit to be mined; and, (b) extracting through said entry a first, substantially horizontal layer of adjacent slices from the deposit, each of said slices extending in a substantially horizontal plane and having an upper and lower surface, the upper and lower surfaces of said slices forming a substantially continuous roof and floor, respectively, above and below said slices, the vertical separation between said surfaces being sufficiently small that elastic downward deformation of said roof due to settling will cause a portion of said roof to contact and be supported by a portion of said floor; and (c) subsequently extracting through said entry at least a second layer from the deposit, said second layer comprising a number of adjacent, horizontally-extending slices in a substantially horizontal plane immediately above the roof of the first layer of slices, each slice of said second layer having a upper surface with the upper surfaces of the slices of said second layer forming a substantially continuous roof wherein the vertical thickness and location of said slices of said second layer with respect to the slices of said first layer are such that elastic downward deformation of the roof of said second layer due to settling will cause a portion of the roof of said second layer to contact and be supported by a portion of the floor of the first layer of slices.

15. A mining method primarily intended for mining coal and other deposits, comprising:

(a) providing an entry adjacent to at least a portion of the deposit to be mined;

(b) extracting through said entry a first, substantially horizontal layer of adjacent slices from the deposit, each of said slices extending in a substantially horizontal plane and having an upper and lower surface, the upper and lower surfaces of said slices forming a substantially continuous roof and floor, respectively, above and below said slices, the vertical separation between said surfaces being sufficiently small that elastic downward deformation of said roof due to settling will cause a portion of said roof to contact and be supported by a portion of said floor; and (c) subsequently extracting through said entry at least a second layer from the deposit, said second layer comprising a number of adjacent, horizontally-extending slices in a substantially horizontal plane immediately above the roof of the first layer of slices, each slice of said second layer having an upper surface with the upper surfaces of the slices of said second layer forming a substantially continuous roof wherein the vertical thickness and location of said slices of said second layer with respect to the slices of said first layer are such that elastic downward deformation of the roof of said second layer due to settling will cause a portion of the roof of said second layer to contact and be supported by a portion of the floor of the first layer of slices, and wherein at least one slice in said first layer is not in vertical alignment with respect to the slices of the second layer, so that said slice in said first layer underlies portions of at least two slices in the second layer.

16. The method of claim 15, wherein the first and second layers have horizontally opposed sides and the horizontally opposed sides of said first layer of slices are within the horizontally opposed sides of the second layer, thereby creating a contoured floor of the excavated deposit that tapers outward and upward from said first layer to said second layer.

17. A mining method primarily intended for mining coal and other deposits, comprising:

(a) providing an entry adjacent to at least a portion of the deposit to be mined;

(b) extracting through said entry a first, substantially horizontal layer of adjacent slices from the deposit, each of said slices extending in a substantially horizontal plane and having an upper and lower surface, each of said slices being formed by the steps of:

(i) drilling a substantially horizontal borehole from said entry extending through the length of the slice to be extracted; and (ii) introducing a water jet into said borehole and extracting said thin horizontal slice of deposit extending laterally from said borehole by means of said water jet;

the upper and lower surfaces of said slides forming a substantially continuous roof and floor, respectively, above and below said slices, the vertical separation between said surfaces being sufficiently small that elastic downward deformation of said roof due to settling will cause a portion of said roof to contact and be supported by a portion of said floor; and (c) subsequently extracting through said entry at least a second layer from the deposit in accordance with the method of (b), said second layer comprising a number of adjacent, horizontally-extending slices in a substantially horizontal plane immediately below the floor of the first layer of slices, each slice of said second layer having a lower surface with the lower surfaces of the slices of said second layer forming a substantially continuous floor wherein the vertical thickness and location of said slices of said second layer with respect to the slices of said first layer are such that elastic downward deformation of the roof of said first layer due to settling will cause a portion of said roof to contact and be supported by a portion of the floor of the second layer of slices.

18. A mining method primarily intended for mining coal and other deposits, comprising:

(a) providing an entry adjacent to at least a portion of the deposit to be mined;

(b) extracting through said entry a first, substantially horizontal layer of adjacent, rectangular slices from the deposit, each of said slices extending in a substantially horizontal plane and having an upper and lower surface, each of said slices being formed by the steps of:

(i) drilling a substantially horizontal borehole from said entry extending along the midline of the rectangular slice to be extracted;

(ii) introducing a water jet into said borehole and cutting a thin rectangular slice extending laterally from opposing lateral sides of said borehole by means of said water jet, the slurry of deposit cut by said water jet being extracted through said borehole to said entry;

the upper and lower surfaces of said slices forming a substantially continuous roof and floor, respectively, above and below said slices, the vertical separation between said surfaces being sufficiently small that elastic downward deformation of said roof due to settling will cause a portion of said roof to contact and be supported by a portion of said floor; and (c) subsequently extracting through said entry at lest a second layer from the deposit in accordance with the method of (b), said second layer comprising a number of adjacent, horizontally-extending, rectangular slices in a substantially horizontal plane immediately below the floor of the first layer of slices, each slice of said second layer having a lower surface with the lower surfaces of the slices of said second layer forming a substantially continuous floor wherein the vertical thickness and location of said slices of said second layer with respect to the slices of said first layer are such that elastic downward deformation of the roof of said first layer due to settling will cause a portion of said roof to contact and be supported by a portion of the floor of the second layer of slices.

19. The method of claim 18, wherein at least one slice in said second layer is not in vertical alignment with respect to the slices of the first layer, so that said slice in said second layer underlies portions of at least two slices in the first layer.

20. The method of claim 18, wherein the first and second layers have horizontally opposed sides and the horizontally opposed sides of said second layer of slices are within the horizontally opposed sides of the first layer, thereby creating a contoured floor of the excavated deposit that tapers inward and downward from said first layer to said second layer.

21. The method of claim 18, wherein during the respective excavating of steps (b) and (c), a thin wall is left between horizontally adjacent slices in each layer.

22. The method of claim 21, wherein at least one slice in said second layer is not in vertical alignment with respect to the slices of the first layer, so that said slice in said second layer underlies portions of at least two slices in the first layer, and underlies the thin wall separating said two slices in said first layer.

* * * * *